US006212849B1

(12) United States Patent
Pellock

(10) Patent No.: US 6,212,849 B1
(45) Date of Patent: Apr. 10, 2001

(54) PULTRUDED FIBERGLASS REINFORCED SHEAR PANEL

(75) Inventor: Michael A. Pellock, Edwardsville, IL (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/224,917

(22) Filed: Jan. 4, 1999

(51) Int. Cl.[7] ..... E04C 3/16

(52) U.S. Cl. ..... 52/693; 52/695; 52/762; 52/167.3; 52/729.2

(58) Field of Search ..... 52/693, 694, 695, 52/729.2, 729.4, 729.1, 656.2–656.8, 800.12, 800.18, 741.1, 762

(56) References Cited

U.S. PATENT DOCUMENTS

| | | | | |
|---|---|---|---|---|
| 178,076 | * | 5/1876 | Nostrand | 52/729.2 |
| 1,946,049 | * | 2/1934 | Weiskopf et al. | 52/792.2 |
| 5,072,570 | * | 12/1991 | Johnson | 52/167.3 |
| 5,230,190 | * | 7/1993 | Schuette | 52/693 X |
| 5,476,704 | * | 12/1995 | Köhler | 52/729.2 |
| 5,492,583 | | 2/1996 | Fingerson et al. . | |
| 5,540,797 | | 7/1996 | Wilson . | |
| 5,706,626 | * | 1/1998 | Mueller | 52/800.12 |
| 5,729,950 | * | 3/1998 | Hardy | 52/693 |
| 5,848,512 | * | 12/1998 | Conn | 52/729.1 |
| 5,904,025 | * | 5/1999 | Bass et al. | 52/167.3 X |
| 6,073,413 | * | 6/2000 | Tongiatama | 52/693 |

* cited by examiner

*Primary Examiner*—Richard Chilcot
(74) *Attorney, Agent, or Firm*—Armstrong Teasdale LLP

(57) ABSTRACT

A shear panel configured to fit between adjacent studs in a stud wall is described. The shear panel in one embodiment of the present invention includes an elongate I-shaped member, a top shear cap, and a bottom shear cap. The elongate I-shaped member includes a central region and two opposing flanges extending longitudinally along opposing outer edges of the central region. The elongate I-shaped member is configured to fit between adjacent studs with the flanges in face to face contact with the faces of the adjacent studs. Each shear cap includes an elongate flat section, a first elongate leg section, and a second elongate leg section. The first and second leg sections extend perpendicularly from the elongate flat section, and the leg sections are configured so that an end of the central region of the I-shaped member fits between the legs. The first leg section is positioned inward from a first longitudinal edge of the flat section, and the second leg section is positioned inward from a second longitudinal edge of the flat section of the top shear cap. A first ear section of the cap is formed between the first longitudinal edge and the first leg, and a second ear section of the cap is formed between the second longitudinal edge and the second leg. The shear panel is positioned within the plane of the stud wall and does not extend out past the plane defined by the outer edges of the studs.

17 Claims, 4 Drawing Sheets

PULTRUDED FIBERGLASS REINFORCED SHEAR PANEL

FIELD OF THE INVENTION

This invention relates generally to wall structures and more particularly, to fiberglass reinforced shear panels for providing added shear strength to wall structures.

BACKGROUND OF THE INVENTION

Wall panels, such as framing wall members or stud walls, generally are used in a wide variety of construction to facilitate erecting walls for a building structure. The wall panels are typically fabricated from wood and include a wall base plate, a wall top plate, and wall studs extending between the top and base plates. To provide the required shear strength of the wall, and to handle lateral loads on the wall, a plywood panel may be nailed to the studs and the top and base plates. The plywood panel is usually nailed to the outer surfaces of the studs at the corners of the structure. In this position, the plywood panel can interfere with the installation of the normal outer sheathing and the final decorative surface of the structure.

Problems may arise if the thicknesses of the sheathing and the plywood panel are not the same. The thickness differential may interfere with subsequent installation of for example the exterior siding of the building. Applying the plywood panel to the surfaces of the studs facing the interior of the structure interferes with the installation of drywall, which is typically used to finish interiors of structures.

It would be desirable to provide a shear panel that will provide the desired shear strength and not interfere with subsequent installation of the exterior sheathing or interior drywall.

SUMMARY OF THE INVENTION

These and other objects may be attained by a shear panel configured to be attached within a stud wall between adjoining studs and the top and bottom plates. The shear panel is positioned within the plane of the stud wall and does not extend beyond the plane defined by the outer edges of the studs. Therefore, the shear panel does not interfere with any subsequent installation of exterior sheathing or interior drywall.

The shear panel includes, in one embodiment, an elongate I-shaped member, a top shear cap, and a bottom shear cap. The elongate I-shaped member includes a central region and two opposing flanges extending longitudinally along opposing outer edges of the central region. The elongate I-shaped member is configured to fit between adjacent studs with the flanges in face to face, or surface to surface, contact with the faces of adjacent studs.

Each shear cap includes an elongate flat section, a first elongate leg section, and a second elongate leg section. The first and second leg sections extend perpendicularly from the elongate flat section, and the leg sections are configured so that an end of the central region of the I-shaped member fits between the legs. The first leg section is positioned inward from a first longitudinal edge of the flat section, and the second leg section is positioned inward from a second longitudinal edge of the flat section of the top shear cap. A first ear section of the cap is formed between the first longitudinal edge and the first leg, and a second ear section of the cap is formed between the second longitudinal edge and the second leg.

To install the shear panel in a stud wall of a structure, the top and bottom shear caps are attached to the I-shaped member at opposing ends of the central region. An adhesive material may be used to bond the top shear cap and the bottom shear cap to the I-shaped member of the shear panel during installation into the stud wall. Metal fasteners, for example screws, may also be used. The shear panel is then positioned between adjacent studs in the stud wall with the flanges in surface to surface contact with the side surfaces of the adjacent studs. Next, the top shear cap is fastened to the bottom surface of the top plate, and the bottom shear cap is fastened to the top surface of the bottom plate.

The above described shear panel provides added shear strength to a stud wall. Further, the shear panel does not interfere with subsequent installation on the stud wall of exterior sheathing or interior dry wall. Particularly, the shear panel is configured so that the shear panel is positioned within the plane of the stud wall, i.e., the cavity formed by the adjacent studs and the top and bottom plates of the stud wall.

DETAILED DESCRIPTION

The present invention is generally directed toward a shear panel particularly useful in building construction to provide building walls with added shear strength. Although a specific exemplary geometric configuration of the panel is provided below, it should be understood that other geometric configurations are possible.

Figure 1:
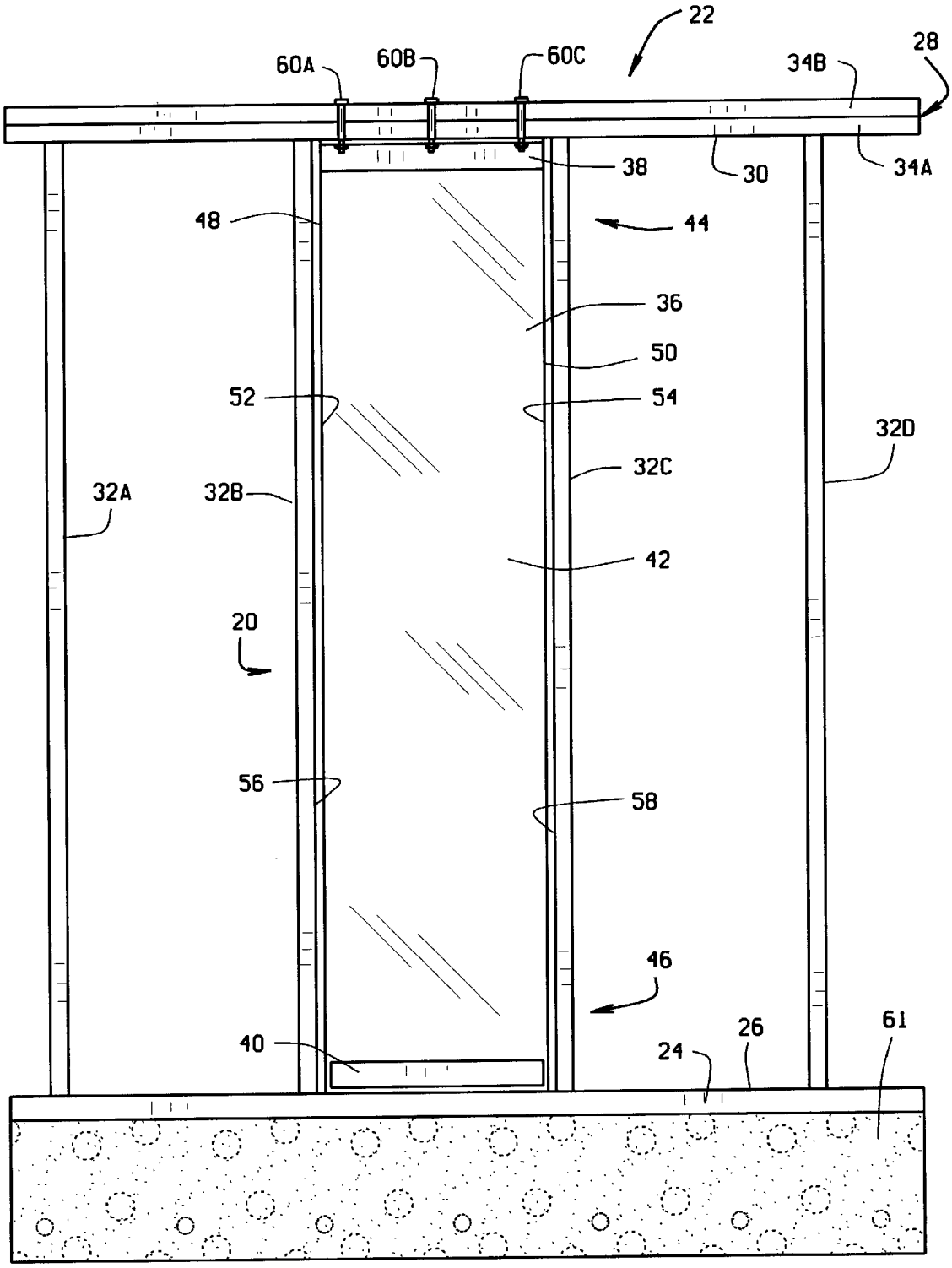
FIG. 1 is a front view of a shear panel, in accordance with an exemplary embodiment of the present invention, mounted in a stud wall.

FIG. 1 is a side view of a shear panel 20 constructed in accordance with one embodiment of the present invention and mounted in a stud wall 22. Stud wall 22 includes a bottom plate 24 having a top surface 26, a top plate 28 having a bottom surface 30, and studs 32A, 32B, 32C, and 32D extending perpendicularly between bottom plate 24 and top plate 28. In this configuration, top plate 28 is referred to as a double top plate and is formed by boards 34A and 34B.

Shear panel 20 includes an elongate I-shaped member 36, a top shear cap 38, and a bottom shear cap 40. Top shear cap 38 is secured to top plate 28 and bottom shear cap 40 is secured to bottom plate 24.

Elongate I-shaped member 36 includes a central region 42, having a first end 44 and a second end 46, and two opposing flanges 48 and 50 extending longitudinally along opposing outer edges 52 and 54 respectively of central region 42. Elongate I-shaped member 36 is configured to fit between adjacent studs 32B and 32C with flange 48 in surface to surface contact with a side surface 56 of stud 32B, and flange 50 in surface to surface contact with a side surface 58 of stud 32C. Fasteners 60A, 60B, and 60C secure shear panel 20 to top plate 28. Similarly, shear panel 20 may be secured to bottom plate 24 with fasteners, such as for example fasteners protruding up from bottom plate 24, or may be secured by nailing or screwing through bottom shear cap 40 into bottom plate 24. Shear panel 20 may alternatively be secured to top plate 28 by nailing or screwing through top shear cap 38 into top plate 28.

To maximize load carrying capacity, shear panel 20 is typically secured to a concrete foundation 61. Usually, bolts are embedded in foundation 61 and are configured to protrude up through bottom plate 24. Alternately, metal tie-downs secured to foundation 61 may be used to secure shear panel 20 to foundation 61. Additionally, on each succeeding floor of the structure being built, shear panel 20 is secured to shear panel 20 installed on the immediately preceding or lower floor. This arrangement permits the load path to extend to foundation 61.

Figure 2:
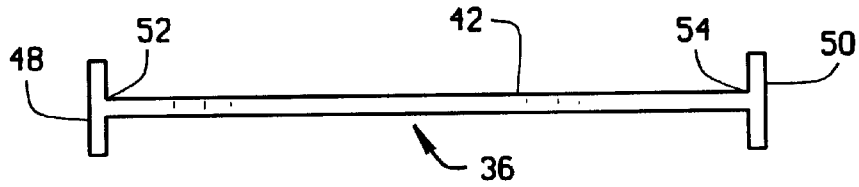
FIG. 2 is a top view of the elongate I-shaped member of the shear panel shown in FIG. 1.

FIG. 2 is a top view of elongate I-shaped member 36 of shear panel 20 showing central region 42 having outer edges 52 and 54, and opposing flanges 48 and 50 extending from edges 52 and 54 as described above.

Figure 3:
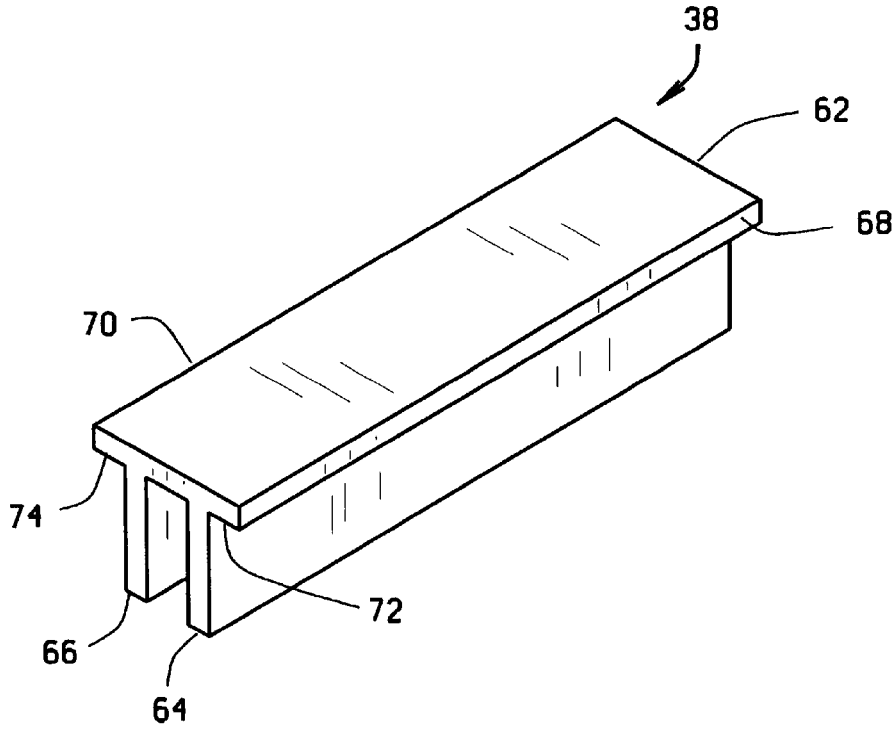
FIG. 3 is a perspective view of the top shear cap of the shear panel shown in FIG. 1.
Figure 4:
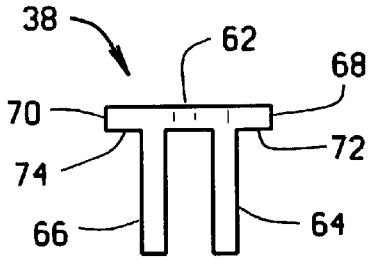
FIG. 4 is an end view of the top shear cap of the shear panel shown in FIG. 1.

Referring to FIGS. 3 and 4, top shear cap 38 includes an elongate flat section 62, a first elongate leg section 64, and a second elongate leg section 66. First and second leg sections 64 and 66 extend perpendicularly from elongate flat section 62. Leg sections 64 and 66 are configured so that a first end 44 of central region 42 of I-shaped member 36 (see FIGS. 1 and 2) fits between legs 64 and 66. First leg section 64 is positioned inward from a first longitudinal edge 68 of flat section 62, and second leg section 66 is positioned inward from a second longitudinal edge 70 of flat section 62 of top shear cap 38. A first ear section 72 is formed between first longitudinal edge 68 and first leg 64, and a second ear 74 section is formed between second longitudinal edge 70 and second leg 66.

Figure 5:
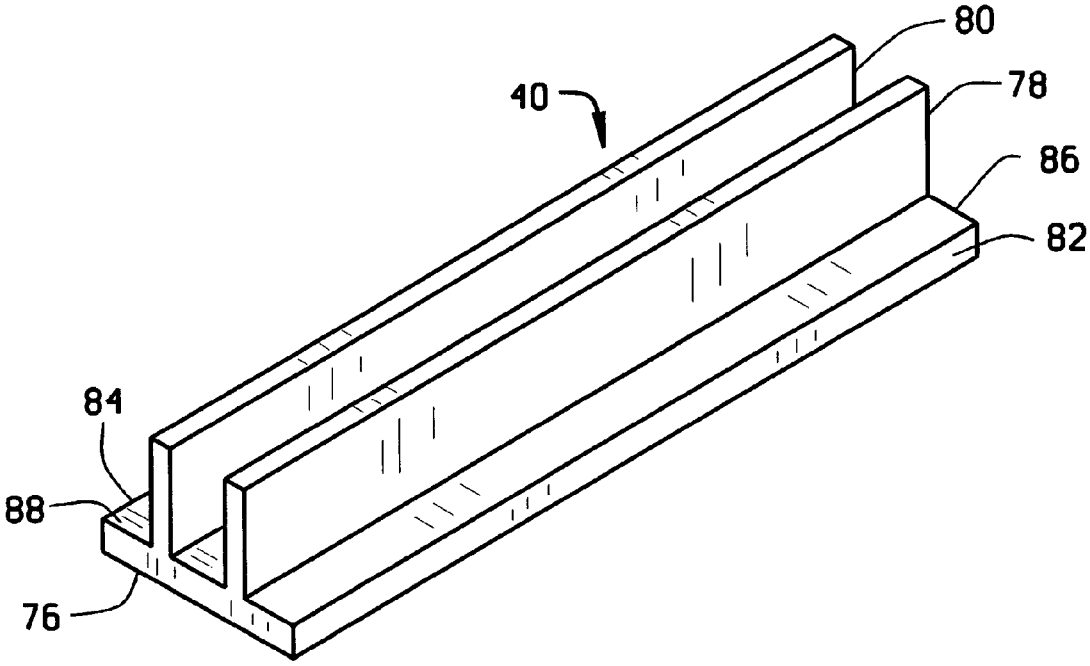
FIG. 5 is a perspective view of the bottom shear cap of the shear panel shown in FIG. 1.
Figure 6:
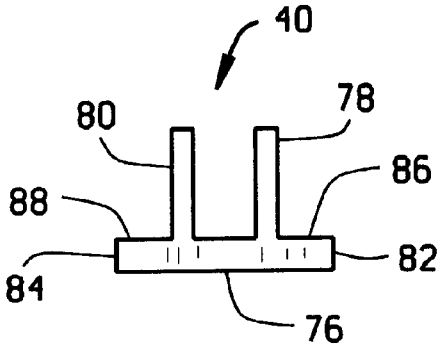
FIG. 6 is an end view of the bottom shear cap of the shear panel shown in FIG. 1.

Referring to FIGS. 5 and 6, bottom shear cap 40 is similar to top shear cap 38 and includes an elongate flat section 76, a first elongate leg section 78, and a second elongate leg section 80. First and second leg sections 78 and 80 extend perpendicularly from elongate flat section 76. Leg sections 78 and 80 are configured so that a second end 46 of central region 42 of the I-shaped member 36 (see FIGS. 1 and 2) fits between legs 78 and 80. First leg section 78 is positioned inward from a first longitudinal edge 82 of flat section 76, and second leg section 80 is positioned inward from a second longitudinal edge 84 of flat section 76 of bottom shear cap 40. A first ear section 86 is formed between first longitudinal edge 82 and first leg 78, and a second ear section 88 is formed between second longitudinal edge 84 and second leg 80.

Shear panel 20, including I-shaped member 36 and top and bottom shear caps 38 and 40, is fabricated from a fiber reinforced resin composite. Typically, the reinforcing fibers are fiberglass, but other commercially available reinforcing fibers may also be used. Thermosetting resins are generally used in the composite. However, in some applications, thermoplastic resins may also be acceptable for use in the composite. Suitable, non-limiting examples of thermosetting and thermoplastic resins include acrylic resins, polyester resins, polyurethane resins, and the like. In one exemplary embodiment, shear panel 20 is fabricated from a fiber reinforced resin composite using a pultrusion process. In a pultrusion process, a plurality of strands of reinforcing fibers, such as fiberglass, are impregnated with a resin and then the resin and fibers are pulled through a profile die. Typically the plurality of strands of reinforcing fibers are configured to reinforce the entire profile of the pultruded part, with greater numbers of fibers in areas of the profile that need more reinforcing strength. The fibers are first pulled through an impregnating vessel filled with molted resin. Then the fibers and resin are pulled through a profile die that is maintained at an elevated temperature to crosslink the thermosetting resin. After exiting the profile die, the pultruded composite is cooled and cut to length. In pultrusion processes using thermoplastic resins, often a cooling die is used to cool the composite below the melting point of the thermoplastic resin while maintaining the desired profile.

To install shear panel 20 in stud wall 22, top and bottom shear caps 38 and 40 are attached to I-shaped member 36. Particularly, first end 44 of central region 42 is inserted into top shear cap 38 between cap legs 64 and 66, and second end 46 of central region 42 is inserted into bottom shear cap 40 between cap legs 78 and 80. An adhesive material may be used to bond top shear cap 38 and bottom shear cap 40 to I-shaped member 36. The adhesive material may be a high bond type of adhesive tape including high bond adhesive on both sides. Typically the high bond tape is applied to ends 44 and 46 of central region 42 of I-shaped member 36 prior to inserting ends 44 and 46 into top and bottom shear caps 38 and 40 respectively. The adhesive material may also be a bead of high bond adhesive applied either to ends 44 and 46, or between legs 64 and 66 of top shear cap 38 and legs 78 and 80 of bottom shear cap 40 prior to the installation of I-shaped member 36 into top and bottom shear caps 38 and 40. Additionally, metal fasteners, for example screws, may be used to secure shear caps 38 and 40 to I-shaped member 36.

Top shear cap 38 is then fastened to bottom surface 30 of top plate 28 between two adjacent studs 32B and 32C with fasteners 60A, 60B, and 60C. Particularly, fastener bolts 60A, 60B, and 60C extend through top plate 28 and ear 72 of top shear cap 38. Likewise fasteners extend through top plate 28 and ear 74. Alternately, screws or nails may be used to secure top shear cap 38 to top plate 28, with the screws or nails extending through ears 72 and 74 into top plate 28. Bottom shear cap 40 is fastened to top surface 26 of bottom plate 24 between adjacent studs 32B and 32C, with fasteners, nails or screws extending through ears 86 and 88 and into bottom plate 24.

The above described shear panel 20 and method of installation provides added shear strength to stud wall 22.

Shear panel 20 will not interfere with subsequent installation onto stud wall 22 of exterior sheathing or interior dry wall. Particularly, shear panel 20 is configured so that shear panel 20 is positioned within the plane of stud wall 22, i.e., the cavity formed by adjacent studs 32B and 32C and top and bottom plates 28 and 26 of stud wall 22.

Figure 7:
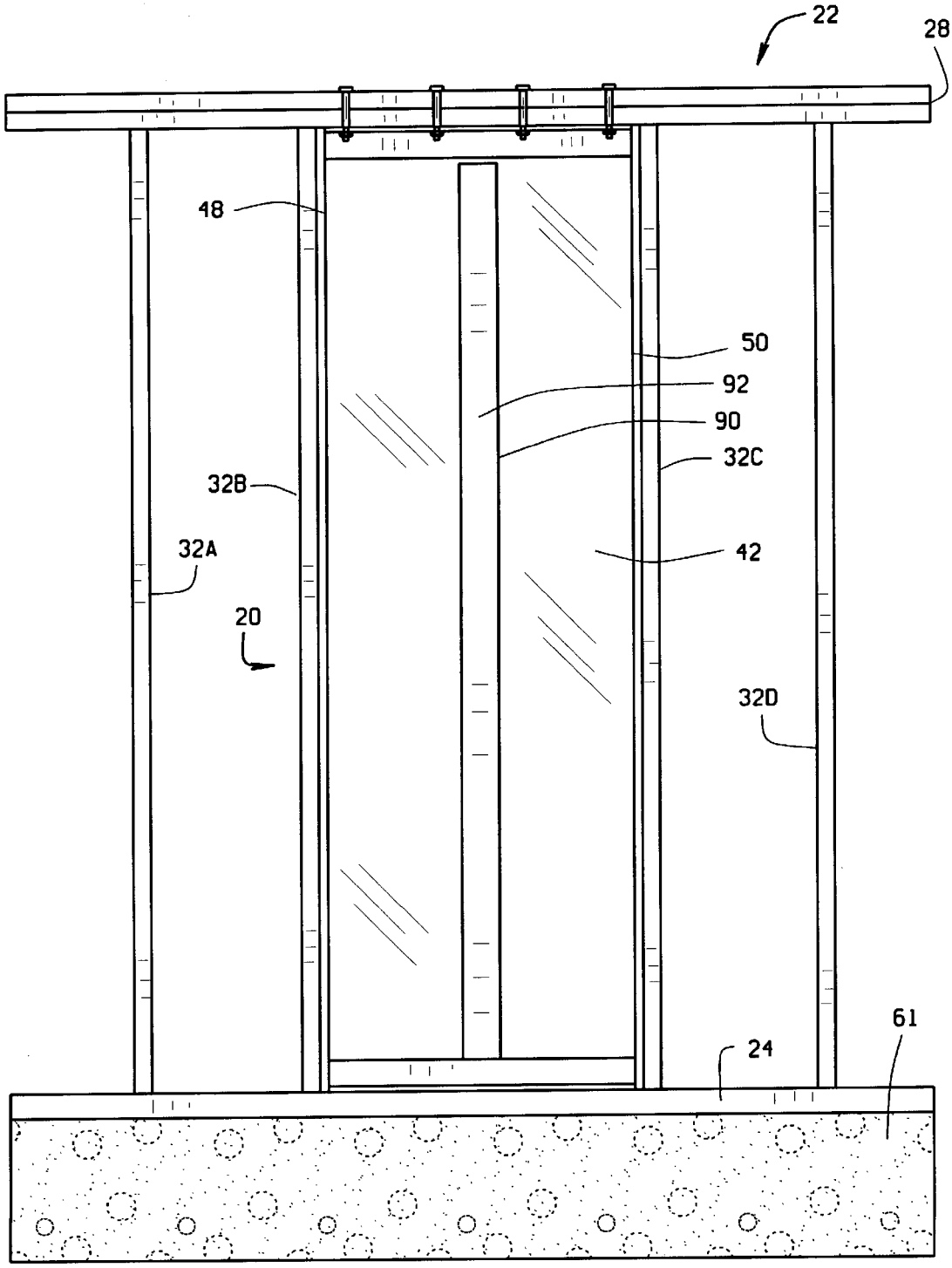
FIG. 7 is a front view of a shear panel, in accordance with another exemplary embodiment of the present invention, mounted in a stud wall.

FIG. 7 shows another embodiment of shear panel 20 mounted in stud wall 22. A wooden nailing strip 90 is attached to central region 40 of I-shaped member 36. Nailing strip 90 extends longitudinally along member 36 and is parallel to flanges 48 and 50. Nailing strip 90 is configured to provide a nailing surface for subsequently installed drywall or exterior sheathing onto stud wall 22. Nailing strip 90 may be installed on one side or both sides of I-shaped member 36. Nailing strip 90 is configured so that when shear panel 20 is installed in stud wall 22, an outer surface 92 of nailing strip 90 is even with the outer surfaces of studs 32*a*, 32B, 32C and 32D and form a stud wall plane.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A shear panel for use in a stud wall of a structure, the stud wall including a top plate, a bottom plate, and studs extending between the top and bottom plates, said shear panel comprising:

an elongate I-shaped member, said elongate member comprising a central region and two opposing flanges, said flanges extending longitudinally along opposing outer edges of said central region, said I-shaped member configured to be secured between adjacent studs and the top and bottom plates of the stud wall;

a top shear cap coupled to a first end of said central region; and a bottom shear cap coupled to a second end of said central region.

2. A shear panel in accordance with claim 1 wherein said top shear cap comprises an elongated flat section, a first elongated leg section, and a second elongated leg section, said first and second leg sections extending perpendicularly from said elongated flat section, and are configured so that a first end of said central region of said elongate I-shaped member fits between said legs, wherein said first leg section is positioned inward from a first longitudinal edge of said elongated flat section and said second leg section is positioned inward from a second longitudinal edge of said elongated flat section, and wherein a first ear section is formed between said first edge and said first leg, and a second ear section is formed between said second edge and said second leg.

3. A shear panel in accordance with claim 1 wherein said bottom shear cap comprises an elongated flat section, a first elongated leg section, and a second elongated leg section, said first and second leg sections extending perpendicularly from said elongated flat section, and are configured so that a second end of said central region of said elongate I-shaped member fits between said legs, wherein said first leg section is positioned inward from a first longitudinal edge of said elongated flat section and said second leg section is positioned inward from a second longitudinal edge of said elongated flat section, and wherein a first ear section is formed between said first edge and said first leg, and a second ear section is formed between said second edge and said second leg.

4. A shear panel in accordance with claim 1 wherein said shear panel comprises a fiberglass reinforced resin composite.

5. A shear panel in accordance with claim 4 wherein said fiberglass reinforced resin composite shear panel is pultruded.

6. A shear panel in accordance with claim 2 wherein said first and second ear sections of said top shear cap contain openings for fasteners.

7. A shear panel in accordance with claim 3 wherein said first and second ear sections of said bottom shear cap contain openings for fasteners.

8. A shear panel in accordance with claim 1 further comprising at least one nailing strip attached to said I-shaped member, said nailing strip extending longitudinally along said I-shaped member and parallel to said opposing flanges.

9. A method of installing a shear panel in a stud wall of a structure, the stud wall including a top plate having a bottom surface, a bottom plate having a top surface, and studs extending between the top and bottom plates, the shear panel including an elongate I-shaped member, a top shear cap, and a bottom shear cap, said method comprising the steps of:

inserting a first end of the elongate member into the bottom shear cap;

inserting a second end of the elongate member into the top shear cap;

fastening the top shear cap to the bottom surface of the top plate between two adjacent studs;

fastening the bottom shear cap to the top surface of the bottom plate between the two adjacent studs.

10. A method in accordance with claim 9 wherein the top shear cap comprises an elongated flat section, a first elongated leg section, and a second elongated leg section, the first and second leg sections extending perpendicularly from the elongated flat section, and are configured so that a first end of a central region of the elongate I-shaped member fits between the legs, wherein the first leg section is positioned inward from a first longitudinal edge of the elongated flat section and the second leg section is positioned inward from a second longitudinal edge of the elongated flat section, and wherein a first ear section is formed between the first edge and the first leg, and a second ear section is formed between the second edge and the second leg, and wherein fastening the top shear cap to the top plate comprises the step of inserting fasteners through the first and second ear sections of the top shear cap and into the top plate of the stud wall.

11. A method in accordance with claim 9 wherein the bottom shear cap comprises an elongated flat section, a first elongated leg section, and a second elongated leg section, the first and second leg sections extending perpendicularly from the elongated flat section, and are configured so that a second end of a central region of the elongate I-shaped member fits between the legs, wherein the first leg section is positioned inward from a first longitudinal edge of the elongated flat section and the second leg section is positioned inward from a second longitudinal edge of the elongated flat section, and wherein a first ear section is formed between the first edge and the first leg, and a second ear section is formed between the second edge and the second leg, and wherein fastening the bottom shear cap to the bottom plate comprises the step of inserting fasteners through the first and second ear sections of the bottom shear cap and into the bottom plate of the stud wall.

12. A method in accordance with claim 11 wherein the structure includes a concrete foundation below the stud wall, and fastening the bottom shear cap to the bottom plate comprises the step of embedding fasteners in the concrete foundation, the fasteners extending up through the bottom plate and through the first and second ear sections of the bottom shear cap.

13. A method in accordance with claim 9 wherein the shear panel comprises a fiberglass reinforced resin composite.

14. A method in accordance with claim 13 wherein the fiberglass reinforced resin composite shear panel is pultruded.

15. A method in accordance with claim 9 further comprising applying a mastic material to the first end and the second end of the elongate I-shaped member.

16. A method in accordance with claim 15 wherein the mastic material comprises a high bond tape covered on both sides with a high bond adhesive.

17. A method in accordance with claim 9 wherein the shear panel further comprises at least one nailing strip attached to the I-shaped member, the nailing strip extending longitudinally along the I-shaped member.

* * * * *